US007798430B2

(12) United States Patent
Kuronita et al.

(10) Patent No.: US 7,798,430 B2
(45) Date of Patent: Sep. 21, 2010

(54) FUEL INJECTION NOZZLE

(75) Inventors: Tokuji Kuronita, Kariya (JP); Satoru Sasaki, Kariya (JP)

(73) Assignee: Denso Corporation, Kariya (JP)

( * ) Notice: Subject to any disclaimer, the term of this patent is extended or adjusted under 35 U.S.C. 154(b) by 353 days.

(21) Appl. No.: 11/896,538

(22) Filed: Sep. 4, 2007

(65) Prior Publication Data

US 2008/0073452 A1 Mar. 27, 2008

(30) Foreign Application Priority Data

Sep. 26, 2006 (JP) ..... 2006-260679

(51) Int. Cl.
*F02M 61/00* (2006.01)

(52) U.S. Cl. ..... 239/533.12; 239/598; 239/599; 239/601; 239/543; 123/305

(58) Field of Classification Search ..... 239/305, 239/543, 596–599, 601; 123/294–305
See application file for complete search history.

(56) References Cited

U.S. PATENT DOCUMENTS

| | | | | |
|---|---|---|---|---|
| 4,313,407 | A | 2/1982 | Müller | |
| 6,322,008 | B1 * | 11/2001 | Aker et al. | 239/543 |
| 6,439,484 | B2 * | 8/2002 | Harata et al. | 239/596 |
| 6,578,778 | B2 | 6/2003 | Koizumi et al. | |
| 6,783,087 | B2 * | 8/2004 | Aoki et al. | 239/596 |
| 7,137,577 | B2 * | 11/2006 | Goenka et al. | 239/533.12 |
| 2007/0095952 | A1 * | 5/2007 | Heinstein et al. | 239/585.1 |

FOREIGN PATENT DOCUMENTS

| | | |
|---|---|---|
| JP | 05-069371 | 9/1993 |
| JP | 11-050848 | 2/1999 |
| JP | 2005-307773 | 11/2005 |

OTHER PUBLICATIONS

Japanese Office Action dated Jan. 20, 2009, issued in corresponding Japanese Application No. 2006-260679, with English translation.

* cited by examiner

*Primary Examiner*—Dinh Q Nguyen
(74) *Attorney, Agent, or Firm*—Nixon & Vanderhye PC

(57) ABSTRACT

A fuel injection nozzle is formed with a nozzle hole group including at least two individual nozzle holes, which are disposed close to each other. Fuel is injected through the nozzle hole group. In at least one combination of two adjacent individual nozzle holes included in the same nozzle hole group, at least one of the two adjacent individual nozzle holes is configured such that each of the at least one of the two adjacent individual nozzle holes has a diameter, the diameter increasing only toward a corresponding adjacent one of the two adjacent individual nozzle holes along a direction from an inside to an outside of the each of the at least one of the two adjacent individual nozzle holes, and the diameter being maximized at an outer opening of the each of the at least one of the two adjacent individual nozzle holes.

4 Claims, 5 Drawing Sheets

(IIC-IIC SECTIONAL VIEW)

FIG. 2C (IIC-IIC SECTIONAL VIEW)

FIG. 3C (IIIC-IIIC SECTIONAL VIEW)

FIG. 4C (IVC-IVC SECTIONAL VIEW)

FIG. 6C PRIOR ART (VIC-VIC SECTIONAL VIEW)

FUEL INJECTION NOZZLE

CROSS REFERENCE TO RELATED APPLICATION

This application is based on and incorporates herein by reference Japanese Patent Application No. 2006-260679 filed on Sep. 26, 2006.

BACKGROUND OF THE INVENTION

1. Field of the Invention

The present invention relates to a fuel injection nozzle.

2. Description of Related Art

Conventionally, in a fuel injection nozzle 100 shown in FIGS. 6A, 6B, 6C, a nozzle hole group 102 is provided by disposing equal to or more than two single nozzle holes 101 close to each other, to improve diffusion of fuel that is injected. By arranging the single nozzle holes 101 close to each other to provide the nozzle hole group 102, sprays of fuel from the single nozzle holes 101 have an area in which they collide and interfere with each other, thereby increasing penetrating force of the sprays in an injecting direction and improving diffusion of fuel. However, in a direct fuel-injection engine such as a diesel engine, when fuel is injected through the nozzle hole group 102, an equivalent ratio tends to be uneven between an area in which sprays collide and interfere with each other and an area in which they do not collide or interfere, thereby often generating black smoke.

In addition, regarding a fuel injection valve that injects fuel into the direct fuel-injection engine, an outlet side of a nozzle hole is enlarged to prevent interference of the sprays of fuel with an intake and exhaust valves or an ignition plug, and to restrict attenuation of swirl force of a swirl flow (e.g., JP2001-214837A). However, according to the above-described art, it is presupposed that the spray is formed through a single nozzle hole, and description of sprays through a nozzle hole group is not given.

SUMMARY OF THE INVENTION

The present invention addresses the above disadvantages. Thus, it is an objective of the present invention to provide a fuel injection nozzle that forms sprays of fuel through a nozzle hole group. The fuel injection nozzle restricts an uneven equivalent ratio between an area in which the sprays collide and interfere with each other and an area in which the sprays do not collide or interfere, which causes generation of black smoke.

To achieve the objective of the present invention, there is provided a fuel injection nozzle formed with a nozzle hole group including at least two individual nozzle holes, which are disposed close to each other. Fuel is injected through the nozzle hole group. In at least one combination of two adjacent individual nozzle holes included in the same nozzle hole group, at least one of the two adjacent individual nozzle holes is configured such that each of the at least one of the two adjacent individual nozzle holes has a diameter, the diameter increasing only toward a corresponding adjacent one of the two adjacent individual nozzle holes along a direction from an inside to an outside of the each of the at least one of the two adjacent individual nozzle holes, and the diameter being maximized at an outer opening of the each of the at least one of the two adjacent individual nozzle holes.

To achieve the objective of the present invention, there is also provided a fuel injection nozzle formed with a nozzle hole group including at least two individual nozzle holes, which are disposed close to each other. Fuel is injected through the nozzle hole group. Two adjacent individual nozzle holes included in the same nozzle hole group open on a recess portion, which has a shape that is dented in a direction opposite from a fuel flowing direction, so that a surface of the recess portion includes respective outer openings of the two adjacent individual nozzle holes.

BRIEF DESCRIPTION OF THE DRAWINGS

The invention, together with additional objectives, features and advantages thereof, will be best understood from the following description, the appended claims and the accompanying drawings in which:

FIG. 2C is a sectional view in FIG. 2B taken along a line IIC-IIC according to the first embodiment;

FIG. 3C is a sectional view in FIG. 3B taken along a line IIIC-IIIC according to the second embodiment;

FIG. 4C is a sectional view in FIG. 4B taken along a line IVC-IVC according to the third embodiment;

FIG. 6C is a sectional view in FIG. 6B taken along a line VIC-VIC.

DETAILED DESCRIPTION OF THE INVENTION

A fuel injection nozzle according to a first embodiment has a nozzle hole group, which includes equal to or more than two single nozzle holes disposed close to each other, and injects fuel through the nozzle hole group. Regarding at least one combination of two adjacent single nozzle holes included in the same nozzle hole group in the above fuel injection nozzle, a cross-sectional surface of at least one single nozzle hole in each of the at least one combination has such a diameter that is described below. That is, the diameter only on a side, on which the other single nozzle hole is positioned, is increased in a direction from the inside to outside of the nozzle, and the diameter is maximized at an outer opening of the corresponding single nozzle hole.

According to a fuel injection nozzle of a second embodiment, an effective diameter of an inner opening (inner opening diameter) of one single nozzle hole is different from an inner opening diameter of the other single nozzle hole. A cross-sectional surface of the other single nozzle hole as well, has such a diameter that is described below. That is, the diameter only on a side, on which the one single nozzle hole is disposed, is increased in the direction from the inside to outside of the nozzle, and the diameter is maximized at the outer opening. The one single nozzle hole and the other single nozzle hole have wall surfaces of their respective diameter-increasing portions. Each of the wall surfaces is formed in a tapered shape, in which it is inclined with respect to a corresponding hole axis, thereby making an inclined angle with the hole axis. The inclined angle of the one single nozzle hole is different from the inclined angle of the other single nozzle hole.

According to a fuel injection nozzle of a third embodiment, two adjacent single nozzle holes included in the same nozzle hole group open on a recess, which is formed in such a manner that an outer surface of a body of the nozzle is caved in toward the inside of the nozzle.

First Embodiment

Figure 1:
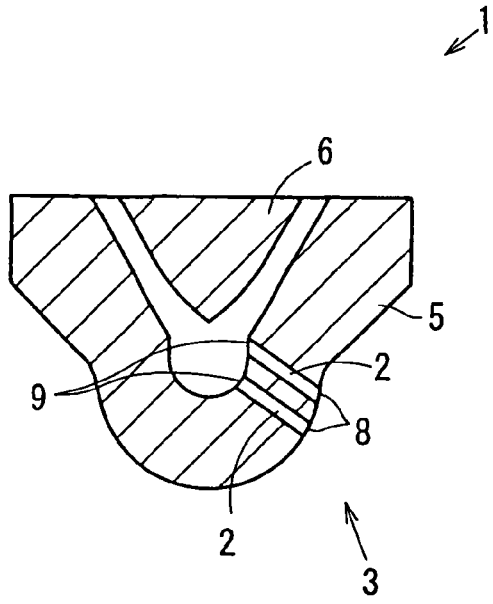
FIG. 1 is a schematic view showing a chief portion of a fuel injection nozzle according to a first embodiment of the present invention.

A configuration of the fuel injection nozzle 1 according to the first embodiment is described below with reference to FIG. 1.

The nozzle 1 has a nozzle hole group 3 as a result of disposing equal to or more than two single nozzle holes 2 close to each other, and injects fuel through the nozzle hole group 3. In addition, the nozzle hole group 3 is provided, for the purpose of promoting atomization of fuel by means of reduction in a diameter of each of the single nozzle holes 2 and a rise in the number of single nozzle holes 2, and increasing penetrating force in an injecting direction by colliding sprays from the single nozzle holes 2 with each other to interfere with each other.

The nozzle 1 includes a body 5, which has the nozzle hole group 3, and a needle 6, which is movably received inside the body 5 and serves as a valve body to open or close the nozzle hole group 3. The nozzle 1 and a magnet valve (not shown), which serves as an actuator of the needle 6, constitute an injector. The injector is installed in, for example, each cylinder of a diesel engine (not shown) and used for injecting and supplying fuel to a combustion chamber (not shown).

In addition, fuel, which is to be injected from the nozzle 1, is discharged from, for example, a widely known fuel injection pump (not shown) after being pressurized and is supplied to the injector through a widely known common rail (not shown). When the magnet valve is actuated, the needle 6 is driven in a direction in which the nozzle hole group 3 is opened, thereby injecting and supplying fuel. When the magnet valve is stopped, the needle 6 is driven in a direction in which the nozzle hole group 3 is closed, thereby stopping the injecting and supplying of fuel.

Figure 2A:
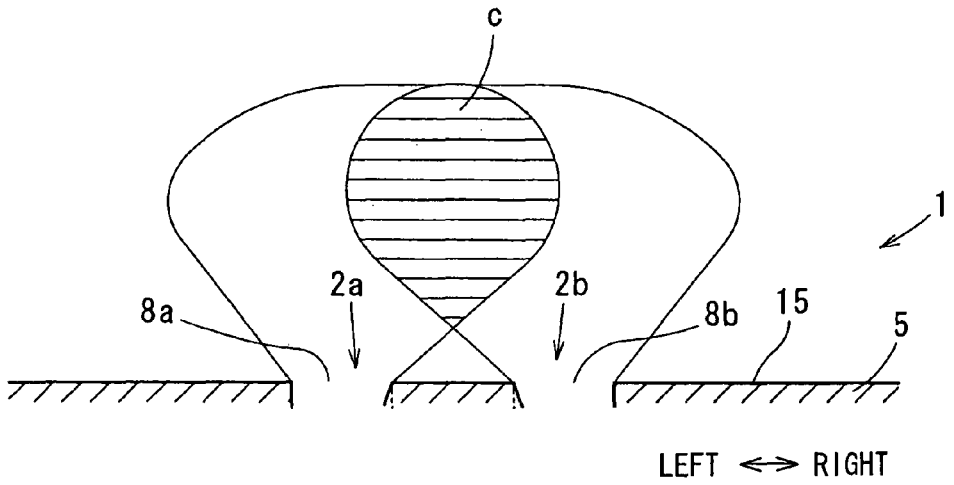
FIG. 2A is an illustrative view showing spraying shapes of fuel from single nozzle holes according to the first embodiment.
Figure 2B:
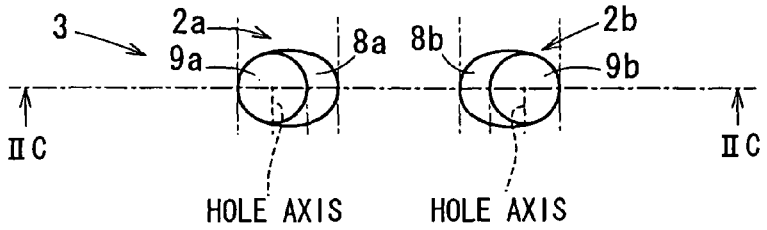
FIG. 2B is a plan view showing outer openings and inner openings according to the first embodiment.
Figure 2B:
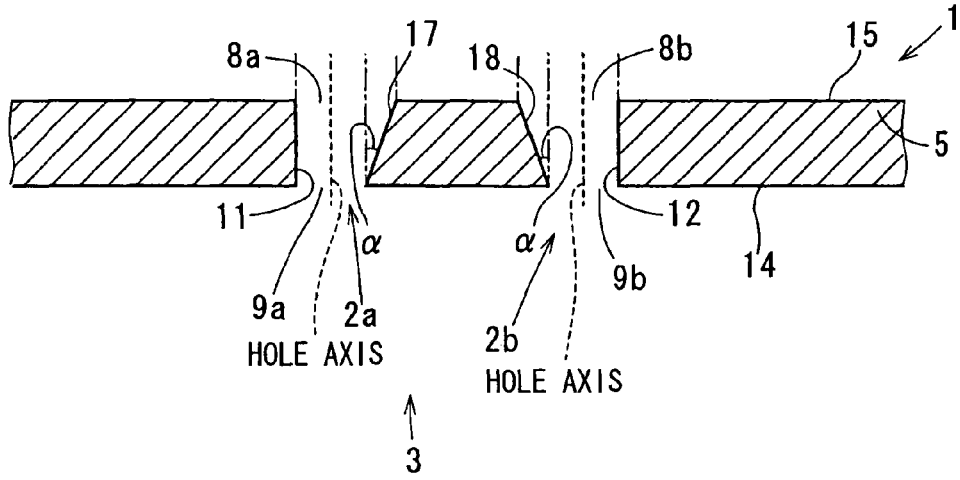

Characteristics of the nozzle 1 of the first embodiment are described below with reference to FIGS. 2A, 2B, 2C.

According to the nozzle 1 of the first embodiment, at least one combination of two adjacent single nozzle holes 2, which constitute the same nozzle hole group 3, is respectively configured such that a diameter of a cross-sectional surface of one single nozzle hole 2*a* only on a side, on which the other single nozzle hole 2*b* is disposed, increases in a direction from the inside toward outside of the body 5, and that the one single nozzle hole 2*a* has a maximum diameter at an outer opening 8*a*. As well, a diameter of a cross-sectional surface of the other single nozzle hole 2*b* only on a side, on which the one single nozzle hole 2*a* is disposed, increases in the direction from the inside toward outside of the body 5, and the other single nozzle hole 2*b* has a maximum diameter at an outer opening 8*b*.

The single nozzle holes 2*a*, 2*b* are configured such that wall surfaces of their diameter-increasing portions, diameters of which are increased in respective directions from inner openings 9*a*, 9*b* toward the outer openings 8*a*, 8*b*, are formed in tapered shapes and inclined with respect to respective hole axes of the single nozzle holes 2*a*, 2*b* to make respective inclined angles with the hole axes. The single nozzle holes 2*a*, 2*b* of the first embodiment have the same inclined angle, that is, an angle $\alpha$. In addition, the outer openings 8*a*, 8*b* have generally oval shapes, which have the same effective diameter, and major axes of which are arranged in the same straight line. The inner openings 9*a*, 9*b* have generally circular shapes having the same diameter.

With reference to a IIC-IIC sectional view of the body 5 taken along the line including the major axes of the outer openings 8*a*, 8*b*, a left sectional edge 11 of the single nozzle hole 2*a* and a right sectional edge 12 of the single nozzle hole 2*b* are perpendicular to an inner surface 14 and an outer surface 15 of the body 5. Also, a right sectional edge 17 of the single nozzle hole 2*a* is inclined clockwise by the angle $\alpha$ with respect to the hole axis of the single nozzle hole 2*a*, and a left sectional edge 18 of the single nozzle hole 2*b* is inclined anticlockwise by the angle $\alpha$ with respect to the hole axis of the single nozzle hole 2*b*.

That is, a wall surface near the right sectional edge 17 and a wall surface near the left sectional edge 18 are formed to approach each other in a direction from the inner surface 14 toward the outer surface 15. A wall surface near the left sectional edge 11 and a wall surface near the right sectional edge 12 are formed to maintain a generally constant distance therebetween in the direction from the inner surface 14 toward the outer surface 15.

According to the nozzle 1 of the first embodiment, at least one combination of two adjacent single nozzle holes 2, which constitute the same nozzle hole group 3, is respectively configured such that the diameter of the cross-sectional surface of the single nozzle hole 2*a* only on the side, on which the single nozzle hole 2*b* is disposed, increases in the direction from the inside toward outside of the body 5, and that the single nozzle hole 2*a* has the maximum diameter at the outer opening 8*a*. As well, the diameter of the cross-sectional surface of the single nozzle hole 2*b* only on the side, on which the single nozzle hole 2*a* is disposed, increases in the direction from the inside toward outside of the body 5, and the single nozzle hole 2*b* has the maximum diameter at the outer opening 8*b*.

Accordingly, sprays of fuel from the single nozzle holes 2*a*, 2*b* form an area C in which they collide and interfere with each other, and a quantity of fuel injected in a direction toward the area C increases compared to the conventional art. That is, a difference between a quantity of fuel injected in a direction in which the sprays collide and interfere and a quantity of fuel injected in a direction in which the sprays do not collide or interfere is made smaller than the conventional art. Because of the reduction in the difference between the quantities of fuel, penetrating force (penetration) of the spray applied in the direction in which the sprays collide and interfere is made great. Thus, a difference between the penetration in the direction in which the sprays collide and interfere and penetration in the direction in which the sprays do not collide or interfere is made smaller than the conventional art. As a result, utilization of air in the combustion chamber is promoted, thereby restricting generation of black smoke.

Second Embodiment

Figure 3A:
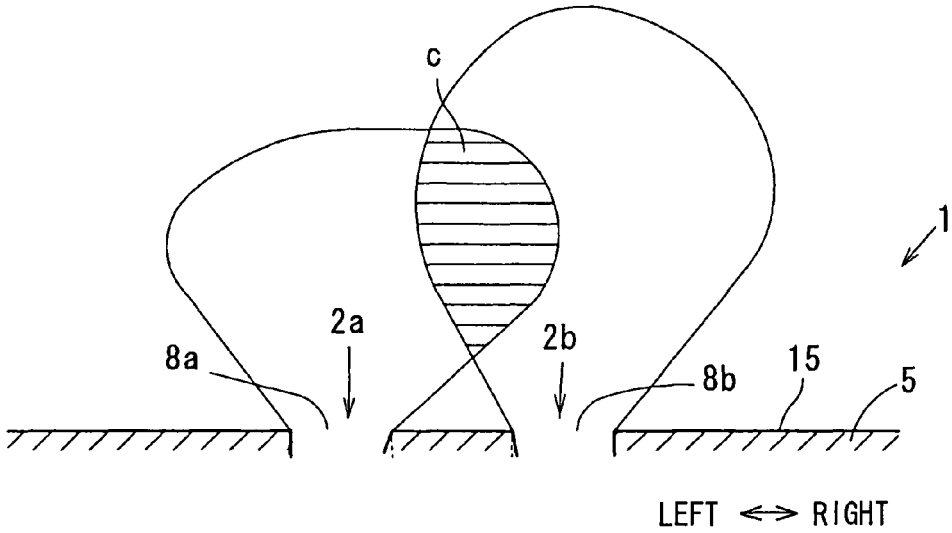
FIG. 3A is an illustrative view showing spraying shapes of fuel from single nozzle holes according to a second embodiment of the present invention.
Figure 3B:
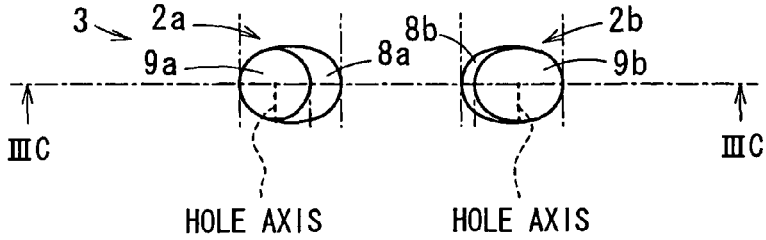
FIG. 3B is a plan view showing outer openings and inner openings according to the second embodiment.
Figure 3B:
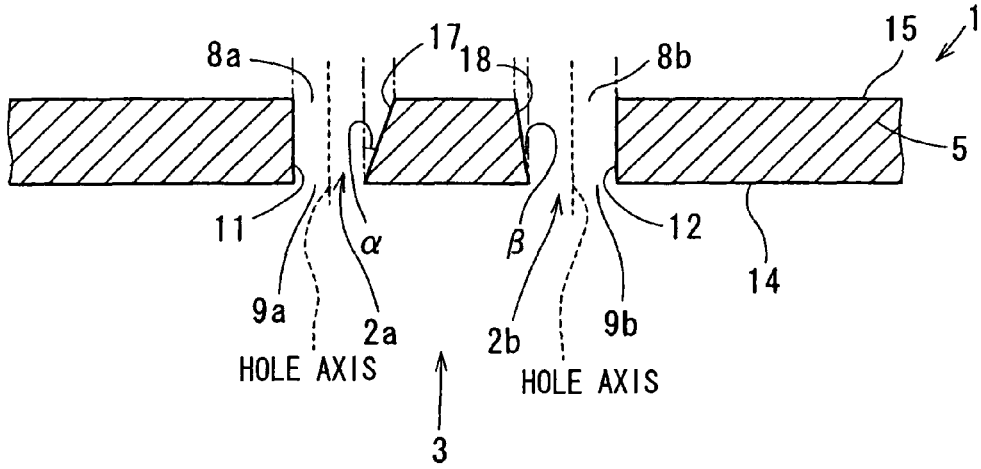

Characteristics of the nozzle 1 of the second embodiment are described below with reference to FIGS. 3A, 3B, 3C.

In the nozzle 1 of the second embodiment, an effective diameter of an inner opening 9*b* is different from an effective diameter of an inner opening 9*a*. Furthermore, single nozzle holes 2*a*, 2*b* have different inclined angles from each other.

That is, the inner opening 9*a* has a generally circular shape, and the inner opening 9*b* has a generally oval shape, which has the larger effective diameter than the effective diameter of the inner opening 9*a*. Outer openings 8*a*, 8*b* have generally oval shapes, and respective major axes of the inner opening 9*b* and the outer openings 8*a*, 8*b* are arranged in the same straight line. The inclined angle of the single nozzle hole 2*a* is an angle α, which is the same as the first embodiment. The inclined angle of the single nozzle hole 2*b* is an angle β, which is smaller than the angle α.

With reference to a IIIC-IIIC sectional view of a body 5 similar to the first embodiment, a left sectional edge 11 and a right sectional edge 12 are perpendicular to an inner surface 14 and an outer surface 15. A right sectional edge 17 is inclined clockwise by the angle α with respect to a hole axis of the single nozzle hole 2*a*, and a left sectional edge 18 is inclined anticlockwise by the angle β, which is smaller than the angle α, with respect to a hole axis of the single nozzle hole 2*b*.

Because the effective diameter of the inner opening 9*b* is larger than the effective diameter of the inner opening 9*a*, a quantity of fuel injected from the single nozzle hole 2*b* is larger than a quantity of fuel injected from the single nozzle hole 2*a*, and a spray from the single nozzle hole 2*b* has a longer fuel travel distance near the hole axis of the single nozzle hole 2*b* than the first embodiment. Because the inclined angle (angle β) of the single nozzle hole 2*b* is smaller than the inclined angle (angle α) of the single nozzle hole 2*a*, a spread of a spray of fuel injected from the single nozzle hole 2*b* in a direction toward the single nozzle hole 2*a* is made narrower, thereby decreasing an area C compared to the first embodiment.

In the nozzle 1 of the second embodiment, the effective diameter of the inner opening 9*b* is different from the effective diameter of the inner opening 9*a*.

Since the effective diameters of the inner openings 9*a*, 9*b* are major factors in the quantity of fuel injected from the single nozzle holes 2*a*, 2*b*, respectively, by setting the effective diameters of the inner openings 9*a*, 9*b* to be different from each other, shapes of sprays from the single nozzle holes 2*a*, 2*b* are variously changed. As a result, by varying the effective diameters of the inner openings 9*a*, 9*b* according to irregularities of a shape of the combustion chamber, reaching of the sprays to a wall surface of the combustion chamber is restricted.

In the nozzle 1 of the second embodiment, the single nozzle holes 2*a*, 2*b* have different inclined angles from each other.

As the incline angle becomes larger, a spray spreads more widely and penetration becomes weaker. Accordingly, by setting the inclined angles of the single nozzle holes 2*a*, 2*b* to be different from each other, the quantity of fuel injected and penetration vary in various directions in which the sprays spread from the single nozzle holes 2*a*, 2*b*. That is, by varying the inclined angles of the single nozzle holes 2*a*, 2*b*, the quantity of fuel injected and penetration vary in various directions in which the sprays spread.

Third Embodiment

Figure 4A:
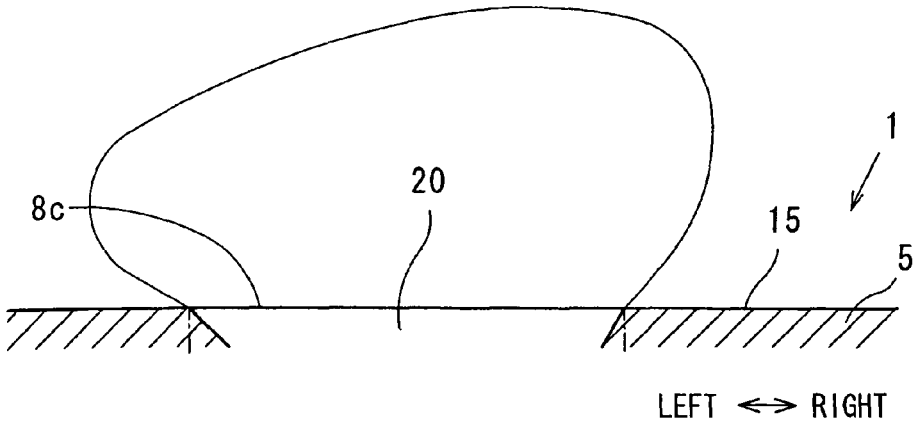
FIG. 4A is an illustrative view showing a spraying shape of fuel from a recess according to a third embodiment of the present invention.
Figure 4B:
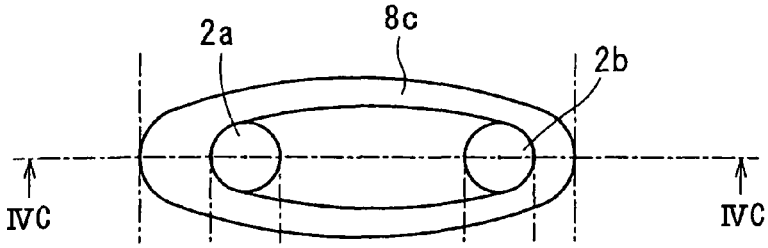
FIG. 4B is a plan view showing an outer opening of the recess according to the third embodiment.
Figure 4B:
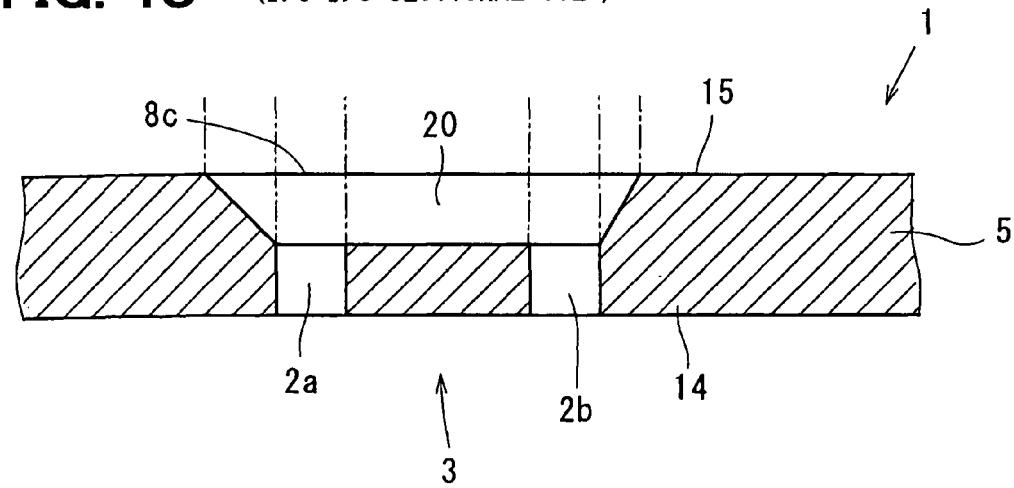
Figure 6A:
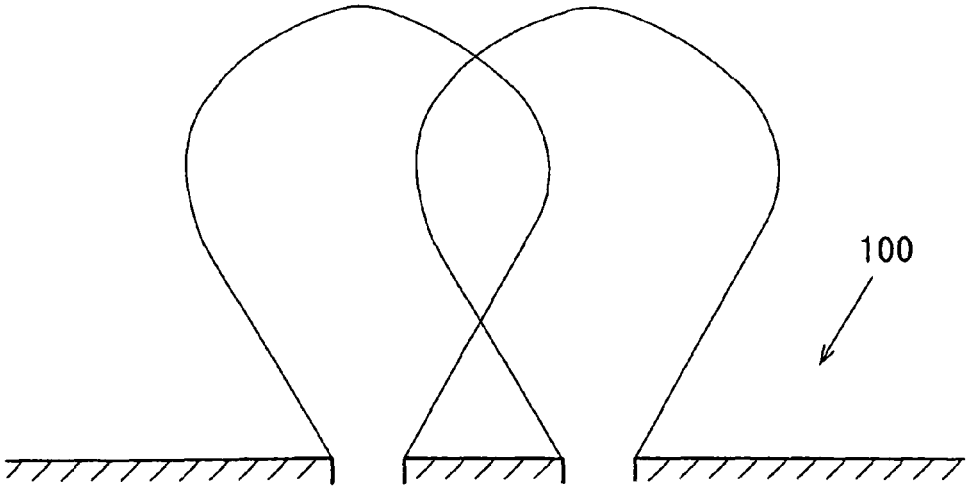
FIG. 6A PRIOR ART
FIG. 6A is an illustrative view showing spraying shapes of fuel from single nozzle holes of a previously proposed fuel injection nozzle.
Figure 6B:
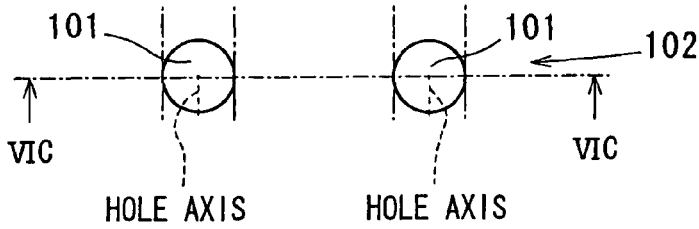
FIG. 6B PRIOR ART
FIG. 6B is a plan view showing the single nozzle holes of the previously proposed fuel injection nozzle.
Figure 6B:
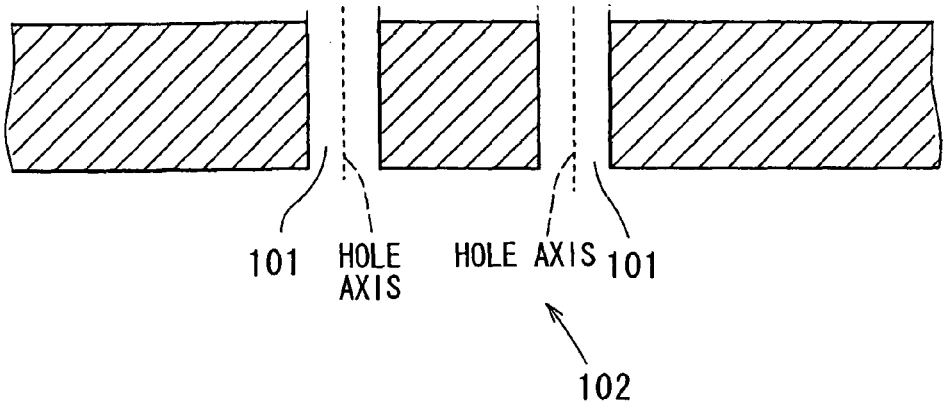
FIG. 6B PRIOR ART

The nozzle 1 of the third embodiment is described below with reference to FIGS. 4A, 4B, 4C.

According to the nozzle 1 of the third embodiment, two adjacent single nozzle holes 2, which constitute the same nozzle hole group 3, open on a recess 20 formed as a result of an outer surface 15 falling in toward the inside of a body 5.

Accordingly, air is mixed into sprays at the recess 20, thereby improving a mixed state between fuel and air. Thus, an equivalent ratio is made even in an area in which the sprays collide and interfere with each other compared to the conventional art, thereby restricting generation of black smoke.

Additionally, the recess 20 opens on the outer surface 15, forming an outer opening 8*c* having a generally oval shape. A IVC-IVC sectional view is a sectional view of the body 5 taken along a line including a major axis of the outer opening 8*c*.

Modifications

Figure 5:
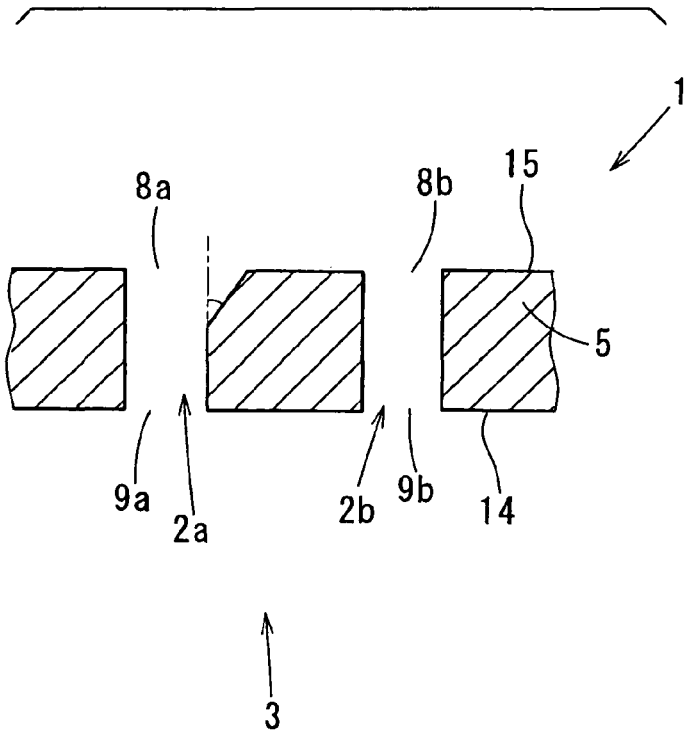
FIG. 5 is an illustrative view showing characteristics of a modified example of the fuel injection nozzle of the first and second embodiments.

According to the single nozzle holes 2*a*, 2*b* in the first and second embodiments, the single nozzle holes 2*a*, 2*b* are formed such that the effective diameters of the outer openings 8*a*, 8*b* are larger than the effective diameters of the inner openings 9*a*, 9*b* respectively, and the diameters of the single nozzle holes 2*a*, 2*b* continuously increase along the entire interval from the inner surface 14 to the outer surface 15. However, the single nozzle holes 2*a*, 2*b* are not limited to such shapes. For example, as shown in FIG. 5, the single nozzle hole 2*b* may be formed such that the effective diameter of the outer opening 8*b* is the same as the effective diameter of the inner opening 9*b*, and the single nozzle hole 2*a* may be formed such that the diameter of the single nozzle hole 2*a* starts to increase at a position located between the inner surface 14 and the outer surface 15 in the direction from the inner surface 14 toward the outer surface 15. Furthermore, according to the single nozzle holes 2*a*, 2*b* in the first and second embodiments, the outer openings 8*a*, 8*b* have generally oval shapes, respectively. However, the outer openings 8*a*, 8*b* may have generally circular shapes.

In addition, the present invention may be applied to equal to or more than three nozzle holes as well. That is, in a case where a nozzle hole group includes three nozzle holes, between two adjacent nozzle holes, a diameter of one nozzle hole may increase in a direction from the one nozzle hole toward the other nozzle hole and may be maximized at an outer opening of the one nozzle hole. The same applies to a case where the nozzle hole group includes equal to or more than four nozzle holes.

Additional advantages and modifications will readily occur to those skilled in the art. The invention in its broader terms is therefore not limited to the specific details, representative apparatus, and illustrative examples shown and described.

What is claimed is:

1. A fuel injection nozzle formed with a nozzle hole group including at least two individual nozzle holes, which are disposed close to each other, wherein:

fuel is injected through the nozzle hole group;

in at least one combination of two adjacent individual nozzle holes included in the same nozzle hole group, the two adjacent individual nozzle holes are configured such that each of the two adjacent individual nozzle holes has a diameter, the diameter increasing only toward a corresponding adjacent one of the two adjacent individual nozzle holes along a direction from an inside to an outside of the each of the two adjacent individual nozzle holes, and the diameter being maximized at an outer opening of the each of the two adjacent individual nozzle holes;

the two adjacent nozzle holes include a first nozzle hole having an inner opening and a second nozzle hole having an inner opening;

wherein an imaginary plane that includes a hole axis of the first nozzle hole, which passes through a center of the inner opening of the first nozzle hole, and a hole axis of the second nozzle hole, which passes through a center of the inner opening of the second nozzle hole, intersects the first nozzle hole at first and second sectional edges and intersects the second nozzle hole at first and second sectional edges, wherein the first sectional edge of the first nozzle hole is located closer to the second nozzle hole than the second sectional edge of the first nozzle hole, and the first sectional edge of the second nozzle hole is located closer to the first nozzle hole than the second sectional edge of the second nozzle hole, the first sectional edge of the first nozzle hole and the first sectional edge of the second nozzle hole approach each other along the direction from the inside to the outside of the respective nozzle hole, and the second sectional edge of the first nozzle hole and the second sectional edge of the second nozzle hole are generally parallel to each other.

2. The fuel injection nozzle according to claim 1, wherein an effective diameter of the inner opening of the first nozzle hole is different from an effective diameter of the inner opening of the second nozzle hole.

3. The fuel injection nozzle according to claim 1, wherein:

each of the two adjacent individual nozzle holes has a diameter-increasing portion, in which the diameter of the each of the two adjacent individual nozzle holes increases along the direction from the inside to the outside of the each of the two adjacent individual nozzle holes;

the diameter-increasing portion is configured such that a wall surface of thereof is formed in a tapered shape and is inclined with respect to the hole axis of each of the two adjacent individual nozzle holes, making an inclined angle with the hole axis; and the inclined angle differs between the two adjacent individual nozzle holes.

4. The fuel injection nozzle according to claim 1, further comprising:

a cylindrical body that includes the nozzle hole group; and a needle that is movably received in the body to open or close the nozzle hole group, wherein the body and the needle define a suction chamber therebetween.

* * * * *